US006779206B1

(12) United States Patent
Sykes

(10) Patent No.: US 6,779,206 B1
(45) Date of Patent: Aug. 24, 2004

(54) URINAL OR TOILET FACILITY APPARATUS

(76) Inventor: John Sykes, Farnley House, Manor Road, Farnley Tyas, Huddersfield (GB), HD4 6UL ( * ) Notice: Subject to any disclaimer, the term of this patent is extended or adjusted under 35 U.S.C. 154(b) by 0 days.

(21) Appl. No.: 10/070,589

(22) PCT Filed: Sep. 6, 2000

(86) PCT No.: PCT/GB00/03418

§ 371 (c)(1),
(2), (4) Date: Mar. 8, 2002

(87) PCT Pub. No.: WO01/18315

PCT Pub. Date: Mar. 15, 2001

(30) Foreign Application Priority Data

Sep. 9, 1999 (GB) ..... 9921192
Oct. 5, 1999 (GB) ..... 9923396

(51) Int. Cl.[7] ..... E03C 1/00
(52) U.S. Cl. ..... 4/661; 4/301; 4/314
(58) Field of Search ..... 4/661, 301, 314, 4/668, 902; 340/573.1; 604/317, 318, 322

(56) References Cited

U.S. PATENT DOCUMENTS 3,585,991 A * 6/1971 Balamuth ..... 601/157
4,636,474 A * 1/1987 Ogura et al. ..... 435/287.3
4,670,798 A * 6/1987 Campbell et al.
4,773,863 A 9/1988 Douglas, III
4,853,678 A * 8/1989 Bishop, Jr. et al.
5,062,304 A * 11/1991 Van Buskirk et al. ..... 73/861
5,410,471 A * 4/1995 Alyfuku et al. ..... 4/661
5,499,008 A * 3/1996 Rosenkrantz et al. ..... 4/300
D370,938 S * 6/1996 Roach ..... D20/10
5,560,051 A * 10/1996 Butts ..... 4/902
5,647,074 A * 7/1997 White, Jr. et al. ..... 4/664
5,657,004 A * 8/1997 Whittaker et al. ..... 340/815.45
5,671,558 A * 9/1997 Lakin
5,720,054 A * 2/1998 Nakayama et al. ..... 4/420
5,781,942 A * 7/1998 Allen et al. ..... 4/623
5,790,036 A * 8/1998 Fisher et al. ..... 340/605
5,867,848 A * 2/1999 Ort ..... 4/661
5,891,051 A * 4/1999 Han et al. ..... 600/573
5,896,591 A * 4/1999 Horan et al. ..... 4/213
5,945,910 A * 8/1999 Gorra ..... 340/573.1
6,219,857 B1 * 4/2001 Wu ..... 4/668
6,298,218 B1 * 10/2001 Lowe et al. ..... 455/66
6,347,414 B2 * 2/2002 Contadini et al. ..... 4/222
6,385,796 B1 * 5/2002 Muir, Jr. ..... 4/661
6,477,718 B1 * 11/2002 Wang et al. ..... 4/300
6,484,148 B1 * 11/2002 Boyd ..... 705/14
6,513,173 B1 * 2/2003 Sykes ..... 4/301
6,572,564 B2 * 6/2003 Ito et al. ..... 600/573
2003/0020704 A1 * 1/2003 Maercovich et al. ..... 345/211

FOREIGN PATENT DOCUMENTS

DE 3822098 A * 1/1990 ..... 4/668
DE 298 11 821 U1 10/1998
DE 197 26 413 A1 1/1999
FR 2 703 499 A1 10/1994
JP 2001-83920 A * 3/2001
JP 2002-155564 * 5/2002 ..... E03D/5/10
WO WO 00/03099 1/2000

* cited by examiner

*Primary Examiner*—Henry Bennett
*Assistant Examiner*—Amanda Flynn
(74) *Attorney, Agent, or Firm*—Woodard, Emhardt, Moriarty, McNett & Henry LLP

(57) ABSTRACT

A toilet or urinal facility having a screen to display video material. A sensor detects the presence of a person in the facility. A memory device stores data from and is connected to the sensor. A video/audio device is connected to the screen to relay messages thereto.

16 Claims, 3 Drawing Sheets

URINAL OR TOILET FACILITY APPARATUS

BACKGROUND OF THE INVENTION

1. Field of the Invention

The invention to which this application relates is to a urinal or toilet facility and particularly, although not necessarily exclusively, to fixtures in the same such as a wall mounted urinal fixture or a toilet seat or a sink, mirror or the like with the facility provided in commercial premises such as, for example, service stations, public houses, stadia and non commercial premises such as public conveniences or even domestic premises.

The applicant's co-pending application Ser. No. PCT/GB99/02064 discloses the ability to provide a visual display as part of a urinal fixture. The urinal is provided with a sensor.

2. Description of the Prior Art

The aim of the present invention is to provide for improvements to the urinal or toilet facilities by providing display means and it should be appreciated that- the description of toilet or urinal facilities include those facilities which include any or any combination of the fixtures such as urinal facilities for males which can be wall mounted and toilet seat facilities or sinks and the like and in general any fixture by which a person is likely to spend some period of time.

In a first aspect of the invention there is provided an apparatus for a toilet or urinal facility, wherein said apparatus includes a screen for the display of video material, which screen is positioned so as to be viewed by a person when using the facility, a sensor provided to detect the presence of a person using the facility and/or at least one fixture in the facility, and characterised in that memory means are provided to allow the storage of data generated from the sensor to indicate the presence of a person or persons in the facility and/or fixture and said data is retrievable from said memory means on site and/or is transmittable via transmission means to the memory means at a remote location, for subsequent display, processing and/or analysis, to provide a record of the exposure of persons to the displayed material.

It should be appreciated that the reference to the toilet or urinal facility above and hereonin is used to define a facility which may include male wall mounted urinal fixtures and/or toilet seat fixtures and/or sinks, hand driers or any other fixture of a urinal or toilet facility and that the inventive features herein described can be used in conjunction with one or a number of said fixtures within the facility and the display screen can be mounted as part of the fixture or separately therefrom and viewable by the person viewing the facility

SUMMARY OF THE INVENTION

In one embodiment the facility fixture is a male urinal which is wall mounted and has a collection area leading to a drain and, depending upwardly from the collection area, a wall and wherein said screen is mounted as part of the wall section.

In an alternative embodiment the screen is located at a position removed from the male urinal fixture but viewable to a person using the same. On the occasion of the fixture having a number of bays for a number of users, the same may be provided with a display screen for each bay or, alternatively, a common screen.

In one embodiment the video and/or audio data can be supplied from a video tape/compact disc or recorded media apparatus located as part of the apparatus or connected to the display screens at a remote location within the premises of the facility ox at a location remote from the premises.

In one embodiment the material to be displayed can be updated from a remote location from the facility premises and/or the recording media which can be a video tape, CD or disc can be replaced or updated by the overwriting of data.

In one embodiment the sensor is arranged to detect the presence of a user of the facility or fixture and a means is provided to allow the storage of details indicating the usage of the facility and/or fixture.

in one embodiment the data from the sensor indicates the frequency of persons entering the area in which a fixture with a display screen is provided, and the data can be stored for subsequent analysis in which frequency and times of usage can be analyzed.

In one embodiment the sensor is provided as an integral part of the fixture or display screen housing and senses the commencement of use of the fixture. In an alternative embodiment the sensor is provided to react to the presence of a person in the immediate vicinity of the fixture. In a yet further embodiment a proximity switch can be used in which the person using the facility changes the condition of a beam of light hence allowing the detection of the presence of the person.

In addition to the sensor acting as a counting means, it can be used to activate a visual display or other features of the facility and/or a further sensor may be provided to allow the activation of the display or other features of the facility.

The provision of the display screen allows information, advertising material or other media to be displayed for viewing by the person when using the fixture.

In one embodiment the display screen condition is activated or the condition is changed in response to the insertion of a coin, token, or card into apparatus 21 (FIGS. 1 and 2) and 221 (FIG. 4) in connection with the display screen or by the activation of a sensor.

The user of the urinal may have paid for the activation via coin or token or card or, alternatively, may have been given same as a promotional scheme.

In one embodiment the display is for a game of chance such as a gambling game activated by inserting the coin, token or card, or alternatively, the user may be able to try and win by activating a sensor connected with the urinal and/or display screen.

In a further embodiment, the means for receiving the coin, token or card and/or display screen are provided as integral parts of the fixture.

It is envisaged that, in whatever embodiment, the display apparatus can be powered from a mains supply or alternatively by portable power sources.

In one embodiment the urinal or toilet facility fixture includes a sensor which is provided to indicate a change in condition of the fixture and wherein the sensor is controlled to react to a specified liquid or liquids.

In one embodiment the sensor is provided to change condition upon use of a male urinal or toilet seat and is controlled to react to urine liquid but not water so as to avoid activation during the flushing process.

In one embodiment the sensor used is a conductive sensor and the sensitivity of the same is adjusted to allow the same to react upon contact with some liquids and exclude others in reaction to the particular conductivity of the liquid.

In one embodiment the urinal or toilet facility incorporates a toilet seat fixture, said seat having mounted in the same or in proximity thereto a sensor, said sensor activated by the presence of a person on said seat or in the vicinity of the same.

Typically the toilet seat fixture includes or is provided with a display screen in proximity thereto.

In one embodiment at least one sensor is provided for detecting the presence of a person using the fixture. The sensor can be provided within the toilet seat and react to pressure applied thereon when a person sits on the same so that the sensor can be maintained in the activated state for as long as the person remains on the seat. When the person leaves the seat the pressure on the sensor changes and so the sensor can be used to sense the number of occasions on which the fixture is used in any given time, by utilizing appropriate processing apparatus to receive the sensor signals. In another embodiment the sensor is a switch device mounted on the seat to contact with the base of the seat with increased pressure when a person sits on the seat. In yet another embodiment the sensor may be a detector mounted in a position on or removed from the seat and which is positioned so as to detect the presence of a person on the seat. This form of sensor could be a PIR infra red sensor. In yet another embodiment the sensor can be provided to sense the flushing of the fixture, such as by detecting the use of the flush mechanism, or the presence or absence of water in the cistern.

It is envisaged that the sensor will be mounted and provided as part of the system which utilizes a screen display, typically positioned to be viewable by a person when sitting on the seat, and said screen can be provided to show advertising material, games or other forms of entertainment. The sensor system can be used to indicate to advertisers the number of persons who are using fixtures in the facility and therefore likely to view the advertising material,- to allow them to gauge the exposure to the advertising material.

In another embodiment, in addition to, or instead of indicating the number of persons using the fixtures, the sensors can be used to activate and deactivate the display of the material being displayed to them.

In one embodiment the screen or sensor or both can be mounted as part of other facility fixtures to the fixture used by the person at that time, such as, for example, being provided as part of a toilet roll holder or in or on a wall or door of the cubicle. Typically audio facilities are also provided to allow the listening of material to occur.

In a further embodiment of the invention the facility incorporates a sink fixture and the sensor is provided to detect the presence of a person at the sink and the screen is positioned to be viewable by a person at the sink. In one embodiment the sensor is provided to detect the use of the water taps of the sink. In addition or alternatively the screen and/or sensor are incorporated in a mirror mounted to be viewable by the person using the sink.

Thus the invention provides a toilet or urinal facility wherein said facility includes a screen for the display of video data and/or speakers for audio data, which screen is positioned so as to be viewed by a person when using a fixture in the facility.

Typically the front display of the screen or a screen enclosing the display screen is made of armored glass and the securing means for the same can be secured in conjunction with adhesive known as hot glue.

BRIEF DESCRIPTION OF THE DRAWINGS

Specific embodiments of the invention will now be described with reference to the accompanying drawings wherein.

DESCRIPTION OF THE PREFERRED EMBODIMENTS

Figure 1:
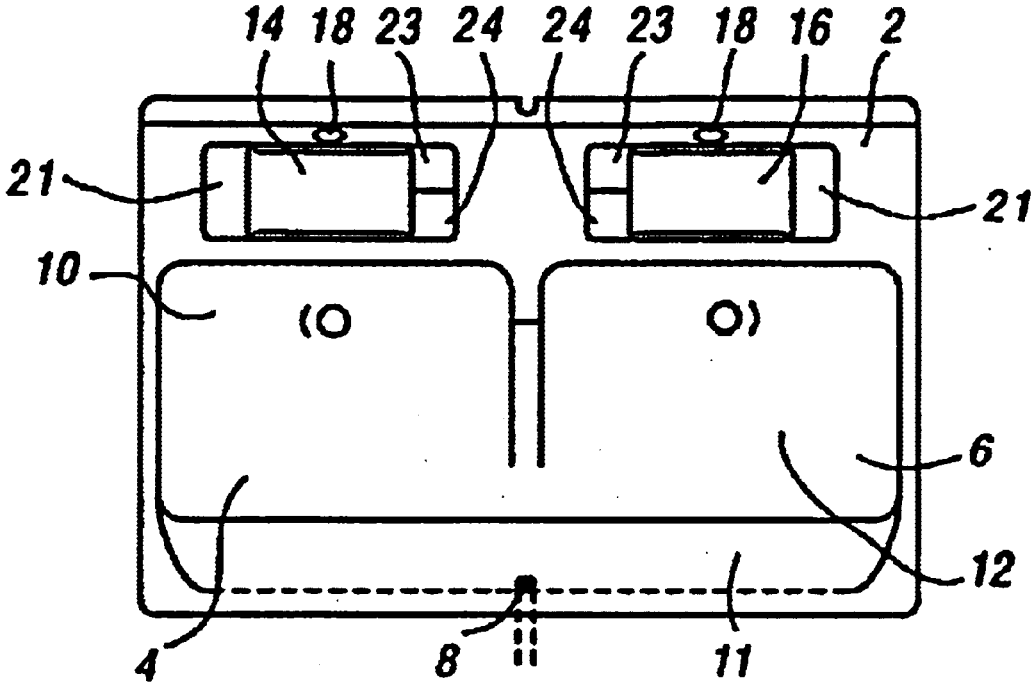
FIG. 1 illustrates a urinal or toilet facility fixture according to one embodiment of the invention.
Figure 2:
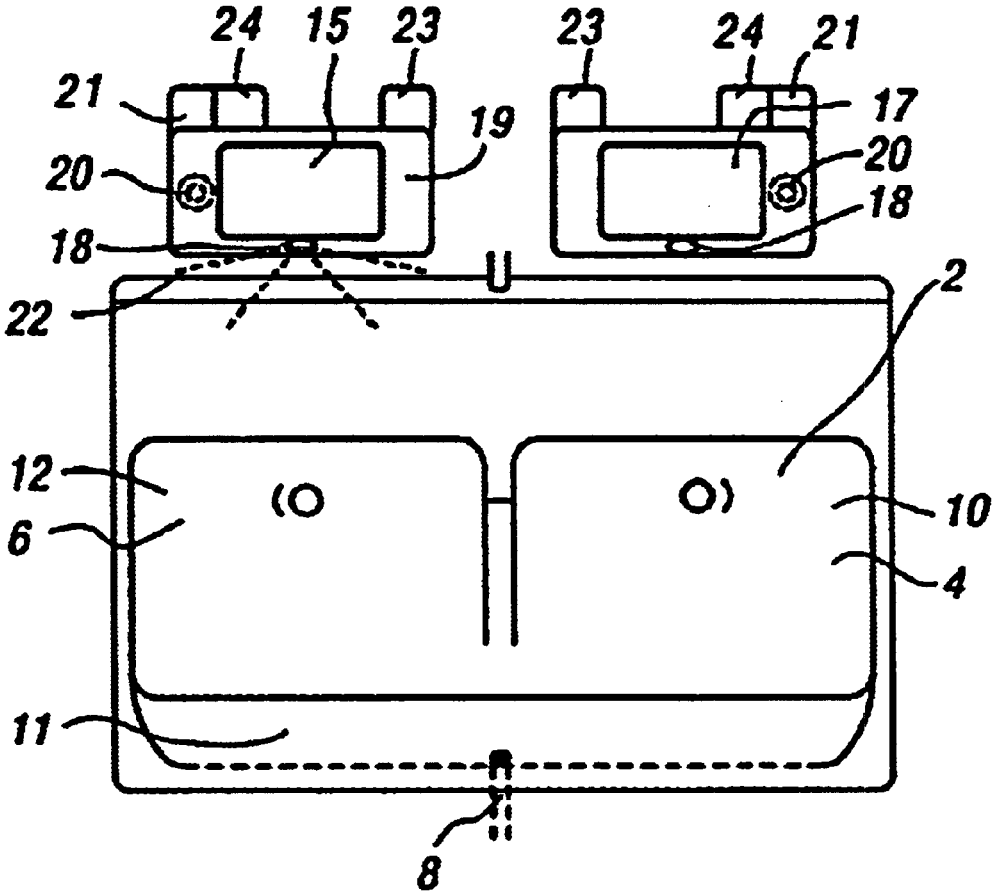
FIG. 2 illustrates a urinal or toilet facility fixture according to a further embodiment of the invention.

Referring to FIGS. 1 and 2 there is illustrated in each embodiment a male urinal fixture 2 according to one embodiment of the invention which includes two bays, 4, 6 each of which has a urinal collection area 11 and which, in the embodiments shown, lead to a common drain 8 for urine. Depending upwardly from the collection areas respectively are walls 10, 12. The fixture is of the sort provided in a urinal or toilet facility within a premises.

In the embodiment of FIG. 1, as part of each fixture wall, there is provided a display screen 14,16.

In FIG. 2 the screens 15, 17 are not provided as integral parts of the urinal fixture wall but are provided as free mounted units, typically in protective housings 19, but they are still, in the terms of the patent, part of the urinal facility and the fixture in question as they are positioned so as to be viewed by persons when at the urinal bays 4,6. For reasons which will become clear later, the ability for the user of the fixture to view the screens when using the fixture and be sensed to be at the urinal fixture at that time, is an important advantage of the current invention.

In whichever embodiment each screen is provided for the display of video data such as advertisements, games and the like. The screens are mounted so as to be viewable by persons using the fixture in the facility and are positioned at a convenient height and may also be angled to allow easy viewing by the user. The display screens are mounted behind a protective front face such as armored glass, and may be positioned a distance behind the front face so that impact on the front face does not necessarily cause damage to the display screen. Speakers, for example 20, in FIG. 2, can also be provided at the same location as the display screens or may be positioned as selected to suit particular facility requirements.

In one embodiment the video and audio data which is generated is done on a continuous basis from a video/compact disc or other storage means apparatus 23 (FIGS. 1 and 2) and 223 (FIG. 4) which in one embodiment can be mounted within the urinal facility or may be positioned at a remote location from but connected to the facility. In an alternative arrangement the generation of the video and/or audio material or a change in the video and/or audio material which is generated can be commenced in response to the activation of a sensor system which signifies that the fixture is being used or that a person has entered the area in which the fixture is mounted and can therefore view the screen when using the fixture.

FIGS. 1 and 2 illustrate the provision of sensors 18 which are positioned to detect the presence of a person using the fixture. Preferably the sensors are provided to allow the detection of the time when a person comes into close proximity with the fixture, as is illustrated by the sensor path 22 shown by broken lines in FIG. 2. It should also be appreciated that the sensors can be positioned in any appropriate position on the fixture or adjacent to the same to provide the requited detection. In one embodiment the sensors are positioned and controlled to detect a person, for example, the torso of the person, and thereby minimise false detections. In one example the sensors can be angled downwardly from a position above the average persons torso position when using a fixture.

The sensor path or detection area is such that, when detected, the person is presumed with a high degree of certainty to be using the fixture and, with the positioning of the display screens as shown, to be watching the display screen. The sensors can also be provided to detect when the person leaves the vicinity of the fixture so that data indicating the start, end and duration of each use can be stored in memory means 24, 224.

The sensors can in one embodiment be connected to software which modifies the way they react so that they recognise a person using the fixture and the sensors can reset automatically immediately a user has left the fixture so that the next 'hit' can be recorded for advertisers or other interested parties.

If audio data is to be generated, suitable speakers can be provided as part of the facility or within the area.

The system for downloading the data can take any suitable form, one being a low maintenance MPEG2 decoder. The hardware can be based on a standard PC with suitable processing means.

The Video data can be output in Composite, SVHS and RGB as an opt on and the system software can be loaded from a single storage means 23, 223. The system can be configured to run from a sensor trigger or constant play.

Figure 3:
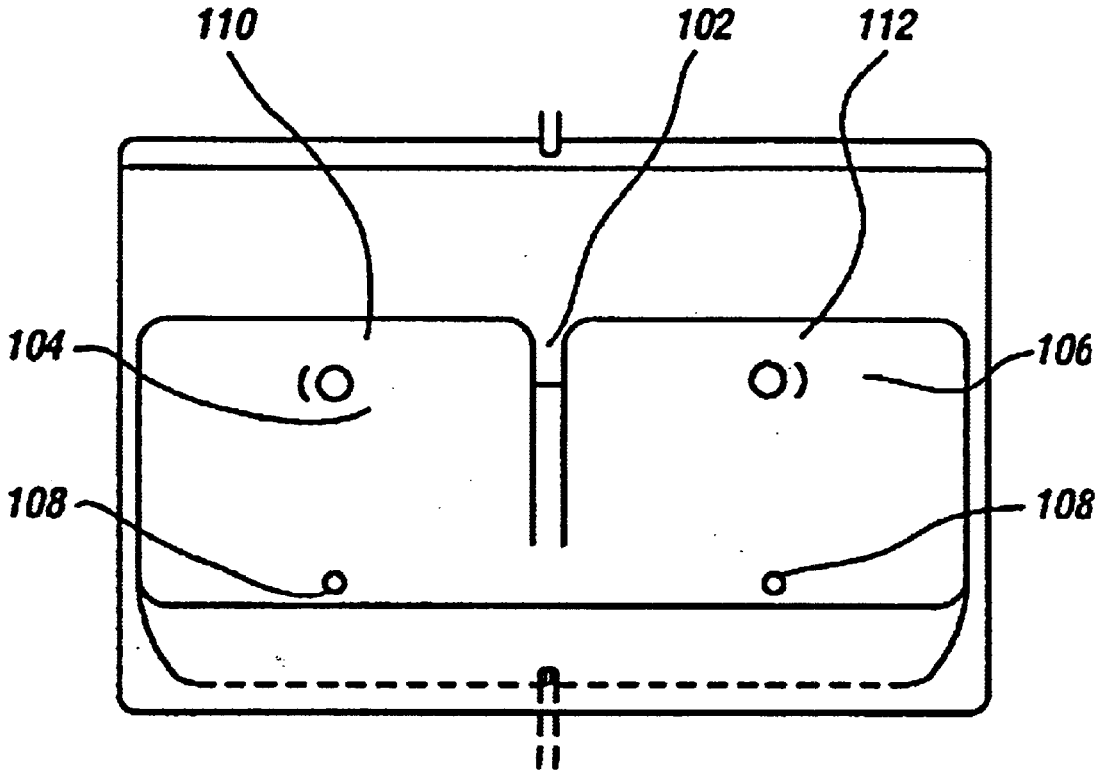
FIG. 3 illustrates a urinal or toilet facility fixture of a yet further embodiment.

FIG. 3 illustrates an alternative embodiment to those of FIGS. 1 and 2 of the invention and which may be used with or without display screens (not shown), wherein there is provided a male urinal fixture 102 with two bays 104, 106. In the embodiment shown each of the bays is provided with a sensor 108 mounted on the respective walls 110,112 of the bays 104,106. The sensors in this embodiment can be provided to react to the impact of urine thereon and thereby cause a signal to be sent. The signal can be used to cause a change in condition of other apparatus for the display of material to the user and/or can, in this aspect, be used to provide a record of the level of usage of the urinal fixture.

Thus usage information can be of value to organizations who may advertise material at the fixture or in the area of the fixture and indicates to them the persons who are viewing the advertisements and the times and peak times of viewing. Thus in whichever embodiment, it should be appreciated that the sensor can be provided as part of the fixture, or separate therefrom but in any case the sensor system used which includes sensors located to detect the presence of a person in the vicinity of the fixture.

Figure 4:
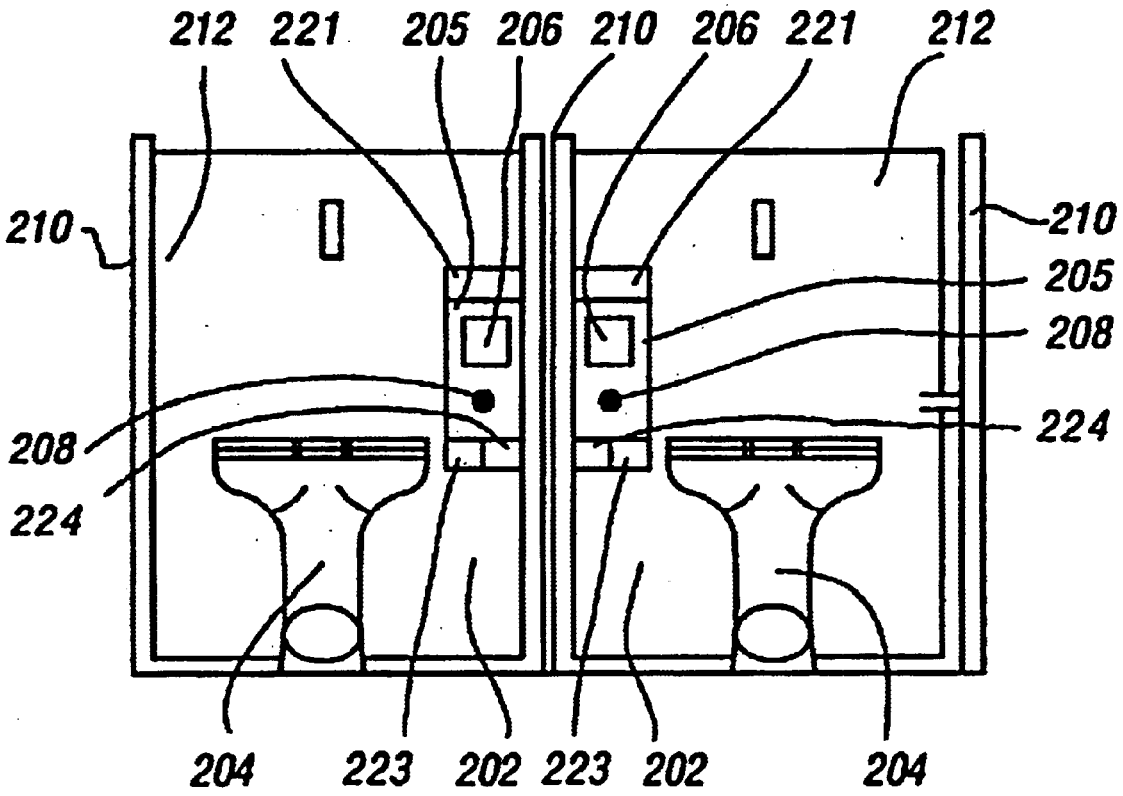
FIG. 4 illustrates a urinal or toilet facility fixture in a further embodiment.
Figure 5:
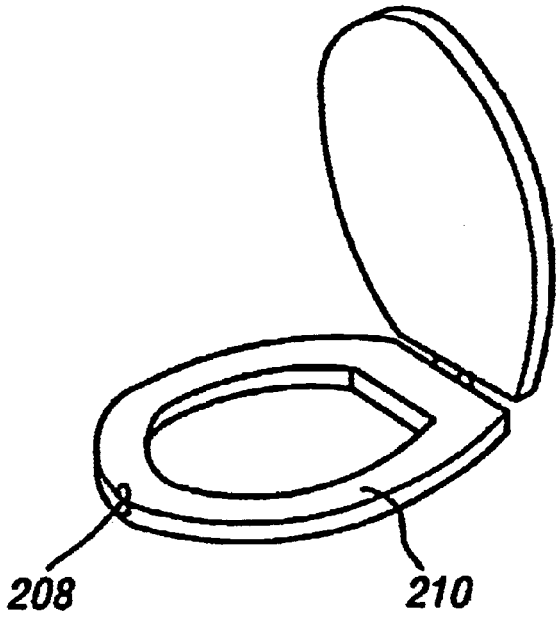
FIG. 5 illustrates a toilet seat fixture in a further embodiment of the invention.

Referring now to FIG. 4 there is illustrated two side by side urinal or toilet fixtures in the form of two cubicles, with the views from the rear of the cubicles, each of which comprises a cubicle 202 having side walls 210 and a door 212, with a toilet seat 204, a housing 205 with a display screen 206, and a sensor 208. The sensor in this case can be a light activated sensor mounted in the display screen housing as shown or could be a pressure sensor 208 mounted in the toilet seat annular part 210 as shown in FIG. 5 which, when a person sits on the seat changes condition. However it should be noted that the sensor used can be any suitable sensor to allow the presence of a person to be detected. Thus when the person is detected the display of material from the display screen commences for the duration of the person sitting on the toilet seat and hence being able to view the display screen.

Although not shown in the drawings, it should be appreciated that the invention can be incorporated in any urinal or toilet facility fixture such as for example as part of a mirror assembly and/or at the location of a sink or a bank of sinks, whereupon the presence of a person at the sink and/or the presence of a person using a water tap at the sink can be sensed and, in addition to the presence of the person being logged and stored for reference as described above with reference to the other embodiments, the detection can cause the commencement of operation or change in condition of a display screen mounted for viewing by the person at the fixture.

In a yet further feature of the invention in a urinal or toilet facility there can be provided a number of fixtures which include a display screen and/or sensor system as herein described which are provided to allow the display of material at the said fixtures. Thus, for example, a person may use the male urinal or toilet seat fixture and view material on a display screen while using that fixture, then move to the sink to wash their hands and view material while using the second fixture on a display screen and then move to dry their hands with an automatic hand dryer and view material on a screen while using that fixture. The screen viewed may be the same in all three cases or may be two or three separate screens depending on the positioning of the fixtures and whether the person could view the same. Furthermore the activation of the material can be by sensors mounted to detect the presence of a person at the respective fixtures.

In each embodiment the sensor can be connected to a control system (not shown), such that when the change in condition of the sensor occurs, this is logged on the control system so that an indication can be provided of the number of users of the fixtures over any given time period and, if required the length of use by each user or users by detecting when the person leaves the fixture. The change in condition of the sensors can also be used to activate the display of material on the display screen for the duration of the change in condition or until the sensor again changes condition.

This data with regard to usage is of great value to advertisers whose material may be displayed via the video and audio material which is generated. Furthermore the data is of great value as it provides an accurate indication of the person having the viewed the material as when the person is using the fixture they cannot leave the fixture and, more importantly with, the proper positioning of the display screens it is very difficult for the person to do anything else but view the material displayed to them. Thus the data can be assumed to have a relatively high degree of accuracy inasmuch that those people whose presence has been detected can be assumed with a high degree of certainty to have viewed the video material. From this, the levels and times of usage can be cross referenced with respect to the times of showing of particular advertising material and so peaks and troughs of usage in terms of time can be calculated and cross referenced with specific advertisers. The data can thus be sold on to the advertisers as of course can the advertising space so that revenue can be obtained through the invention in addition to providing the opportunity to provide entertainment and information to the users of the facility.

In a further feature of the invention the data which is detected by the sensors can be transmitted to a remote location from the facility or from memory means 224 connected to the sensor in the facility. In one embodiment the data is transmitted by uploading the same using transmission means which can also be used for the downloading of video and/or audio data relating to new advertising, entertainment and/or information material for display. The data received by the upload can be installed into a secure web site which advertisers or facility managers or other interested parties who may have paid for the data can access and track the level of use of the fixtures in the facility and hence in the case of advertisers exposure to their advertising material.

Typically the advertising material will be downloaded to storage medium 224 which can be any desired form such as a flash disk which is a form of storage disk and from which the material can be generated on screen continuously or as required. The same storage medium can also be used to store the 'real-time' data about number, frequency and time of uses and this data can be retrieved by the remote connection discussed above or by visiting the facility. This "usage" data is of great value and can be a unique service to advertising companies and their advertisers and is a feature which is not currently available.

The downloading of the data can be -achieved using any suitable system such as for example an internet based system however the increasing expansion of broadband communications both on landline based systems (ISDN, ADSL) and mobile based systems (GPRS, GSM, G3) allow moving images and Alphanumeric type communications to be transmitted reliably at sufficient speed and data quality. The transmission of the data may be implemented with the use of Remote Writer software or any other suitable control and implementation system which is commercially available.

Thus there is provided the provision in a urinal or toilet facility of a display screen with the display screen positioned and used to display a material to the user of a fixture in the facility such as a male urinal, toilet seat, sink, mirror or any other fixture and this in itself is a useful and inventive feature in that the display screen is positioned to allow video material to be viewed by the person using the fixture. However the utility is further improved by the use of a sensor to detect the presence of a person at the fixture. In addition, data relating to the usage of the fixture and when used in conjunction with the display screen exposure to the material displayed on the display screen can be stored and provided to advertisers to whom the material relates, facility providers or other interested parties. Furthermore the data from which the video and/or audio via speakers, is generated can be downloaded to the facility from a remote location and stored in memory via suitable communication systems.

What is claimed is:

1. A toilet or urinal facility having at least one fixture and an apparatus, wherein said apparatus includes a screen for the display of video material, which screen is positioned so as to be viewed by a person when using the facility, said screen displaying video generated from data held in a storage media at the said facility, and a sensor provided to detect the presence of a person using the facility and/or at least one fixture in the facility, and comprising memory means provided to allow the storage of data generated from the sensor to indicate the presence of a person or persons in the facility and/or fixture and said data is retrievable from said memory means when on site and/or is transmittable via transmission means to the memory means when at a remote location, for subsequent display, processing and/or analysis, to provide a record of the exposure of persons to the displayed materials wherein the memory means allows the storage of data generated from the sensor which includes the number of detections made over a predetermined time period to indicate usage of the facility and/or fixture.

2. The facility according to claim 1 wherein the screen is mounted at a position removed from a fixture or as an integral part of a fixture.

3. The facility according to claim 2 wherein when mounted separately from the fixture the display screen is provided in a housing.

4. The facility according to claim 1 wherein the fixture is a urinal fixture which has a urine collection area leading to a drain and, depending upwardly from the collection area, a wall.

5. The facility according to claim 4 wherein the fixture has a number of bays for a number of users, and is provided with a display screen for each bay or a common screen.

6. The facility according to claim 1 wherein the video is held in storage media connected to the screen in the facility.

7. The facility according to claim 6 wherein the material to be displayed is transmitted to the storage media from a remote location at predetermined intervals of time.

8. The facility according to claim 1 wherein activation of the sensor causes activation of the screen or a change in condition of the screen.

9. The facility according to claim 1 wherein the sensor is mounted at or adjacent to the display screen.

10. The facility according to claim 1 wherein said apparatus includes a housing and the facility incorporates a toilet seat fixture with the sensor mounted in said housing in which the display screen is provided to detect the presence of a person on the seat.

11. The facility according to claim 1 wherein the facility incorporates a toilet seat fixture and said seat has mounted in the same a sensor, said sensor activated by the presence of a person on said seat or in the vicinity of the same.

12. The facility according to claim 1 wherein the sensor is mounted on the fixture to indicate a change in condition of the fixture by reacting to a specified liquid or liquids.

13. The facility according to claim 12 wherein the sensor is controlled to react to urine but not water so as to avoid activation during the flushing process of a male urinal fixture or toilet seat fixture.

14. The facility according to claim 12 wherein the sensor is a conductive sensor and the sensitivity of the same is adjusted to allow the same to react with respect to the particular conductivity of the liquid.

15. The facility according to claim 1 wherein the display is activated or the condition of the video material is changed in response to the insertion of a coin, token, or card into apparatus in connection with the display screen or via the activation of a sensor by the presence of a person using the fixture.

16. The facility according to claim 15 wherein upon activation of the facility the user can participate in a game.

* * * * *